US006700545B2

(12) United States Patent
Hareyama

(10) Patent No.: US 6,700,545 B2
(45) Date of Patent: Mar. 2, 2004

(54) ANTENNA APPARATUS AND TRANSMISSION/RECEPTION APPARATUS HAVING SUCH AN ANTENNA APPARATUS

(75) Inventor: Nobuo Hareyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/155,633

(22) Filed: May 23, 2002

(65) Prior Publication Data

US 2002/0180651 A1 Dec. 5, 2002

(30) Foreign Application Priority Data

May 30, 2001 (JP) ..... P2001-161980

(51) Int. Cl.[7] ..... H01Q 1/24

(52) U.S. Cl. ..... 343/702; 343/700 MS; 343/848

(58) Field of Search ..... 343/700 MS, 702, 343/846, 848

(56) References Cited

U.S. PATENT DOCUMENTS 6,011,519 A * 1/2000 Sadler et al. ..... 343/742
6,259,407 B1 * 7/2001 Tran ..... 343/700 MS
6,466,176 B1 * 10/2002 Maoz et al. ..... 343/767
6,484,016 B1 * 11/2002 Cheon ..... 455/90.1

* cited by examiner

*Primary Examiner*—Don Wong
*Assistant Examiner*—Shih-Chao Chen
(74) *Attorney, Agent, or Firm*—Jay H. Maioli

(57) ABSTRACT

A transmission/reception apparatus has a first housing, a second housing, a folding section connecting the first and second housings, a first earth circuit board that has antenna circuitry thereon and that is provided with the first housing, a second earth circuit board that is provided with the second housing, and a flexible conduction member for connecting the first and second earth circuit boards. The first and second earth circuit boards and the flexible conduction member constitute an antenna apparatus, and during use of this antenna apparatus, a predetermined earth pattern length can be established by the first and second earth circuit boards.

4 Claims, 9 Drawing Sheets

ANTENNA APPARATUS AND TRANSMISSION/RECEPTION APPARATUS HAVING SUCH AN ANTENNA APPARATUS

CROSS REFERENCE TO RELATED APPLICATIONS

The present document is based on Japanese Priority Document JP 2001-161980, filed in the Japanese Patent Office on May 30, 2001, the entire contents of which are incorporated herein by reference to the extent permitted by law.

BACKGROUND OF THE INVENTION

1. Field of the Invention

The present invention relates to an antenna apparatus and to a transmission/reception apparatus having such an antenna apparatus. More specifically, the present invention relates to an antenna apparatus capable of attaining a required sensitivity for communication even when a transmission/reception apparatus having such an antenna apparatus is downsized, and the housing for the antenna apparatus is thereby reduced in size.

2. Description of the Related Art

In recent years, there has been a trend towards smaller, thinner and lighter communication devices. This trend is particularly marked in transmission/reception devices for mobile communication, and therefore the need for downsizing antennas used for such devices has become unavoidable. A typical example of a small-size antenna is the patch antenna.

FIG. 7A through FIG. 7C show the structure of a patch antenna 10, wherein FIG. 7A is a plan view, FIG. 7B is a cross-sectional view through section A—A of FIG. 7A and FIG. 7C is a side view of FIG. 7A observed from the right.

In FIG. 7A–FIG. 7C, the patch antenna 10 is positioned on an earth circuit board 1, and comprises a dielectric material 3, a radiator element conductor pattern 4*a* formed on the top surface of the dielectric material 3, an impedance matching conductor pattern 4*b*, an earth conductor pattern 7 formed on the bottom surface of the dielectric material 3, and a power feeding pattern 8 for feeding power to the radiator element conductor pattern 4*a*. The earth circuit board 1 is constructed by adhering a copper plate 1*a* and an insulation board 1*b* together.

Further, the impedance matching conductor pattern 4*b* includes an impedance matching conductor pattern section formed on the same surface as the radiator element conductor pattern 4*a*, as well as an earth conductor pattern section formed along a side surface of the dielectric material 3 in a direction perpendicular to the copper plate 1*a* of the earth circuit board 1. The earth conductor pattern section of the impedance matching conductor pattern 4*b* is connected to the copper plate 1*a*, and, along with the power feeding pattern 8, constitutes a power feeding section as a counterpart earth terminal to the power feeding pattern 8.

In addition, the radiator element conductor pattern 4*a* and the impedance matching conductor pattern 4*b* constitute an antenna pattern section 4. The antenna pattern section 4 and the dielectric material 3 constitute an antenna section 2.

Power is fed to the patch antenna 10 by connecting the radiator element conductor pattern 4*a* to a center conductor of a coaxial cable 6, and the copper plate 1*a* of the earth circuit board 1 to an outer conductor of the coaxial cable 6.

FIG. 8A and FIG. 8B are configuration diagrams of a transmission/reception apparatus 20. FIG. 8A is a plan view, and a speaker 21, a display 22, dial buttons 23 and a microphone 24 are provided. FIG. 8B is a schematic cross-sectional view through section C—C of FIG. 8A, and the patch antenna 10 shown in FIGS. 7A through 7C is attached to the transmission/reception apparatus 20 in the direction of its length by way of some appropriate attaching means not shown in the figures. In this type of a transmission/reception apparatus, because the transmission/reception apparatus 20 has a sufficient length, the earth circuit board 1 of the patch antenna 10 can be elongated, and thus a predefined sensitivity can be attained relatively easily.

FIG. 9A and FIG. 9B are configuration diagrams of a folding transmission/reception apparatus 30. FIG. 9A is a plan view, showing that the folding transmission/reception apparatus 30 is structured so as to be foldable such that, when folded, a dial button side 33 located on one side of a folding section 31 faces a display side 32 located on the other side of the folding section 31. FIG. 9B is a schematic cross sectional view through lines D—D of FIG. 9A showing the folding transmission/reception apparatus 30 as folded. The patch antenna 10 shown in FIGS. 7A through 7C is provided on the dial button side 33 of the folding transmission/reception apparatus 30 by way of some appropriate means not shown in the diagram. This type of transmission/reception apparatus is widely used and popular for its stylish design, and for its handiness as it can be folded and stored in limited spaces such as chest pockets.

However, when the body of the transmission/reception apparatus described above (foldable or not) is downsized, the length of the body is reduced, and thus, a predetermined sensitivity for the bandwidth in use becomes unattainable. For this reason, in the worst case, the transmission/reception apparatus becomes unable to communicate due to inferior sensitivity. In addition, when kept in a chest pocket, for example, there is also the problem that the apparatus is prone to falling out of the chest pocket because it has no means by which it can attach itself to the pocket.

SUMMARY OF THE INVENTION

The present invention is proposed in view of such problems described above. An aspect of the present invention is to configure an antenna which can be housed inside a transmission/reception apparatus, and is capable of attaining a predetermined sensitivity for a frequency band in use, even if the transmission/reception apparatus is downsized, thereby making the antenna housing space smaller.

Another aspect of the present invention is to provide a transmission/reception apparatus having such an antenna.

Yet another aspect of the present invention is to prevent the transmission/reception apparatus having the antenna described above from falling out from, for example, a pocket on clothing when it is carried around or used while stored therein.

An antenna apparatus according to an embodiment of the present invention is characterized by its capability of securing a predetermined earth pattern length which is achieved by connecting an earth circuit board having antenna circuitry mounted thereon to a second earth circuit board using a flexible conduction means when the antenna apparatus is in use.

A transmission/reception apparatus according to an embodiment of the present invention is characterized by its possession of an antenna apparatus which is capable of securing a predetermined earth pattern length which is achieved by connecting an earth circuit board having antenna circuitry mounted thereon to a second earth circuit board using a flexible conduction means when the antenna apparatus is in use.

A transmission/reception apparatus according to another embodiment of the present invention is the transmission/reception apparatus described above wherein the earth circuit board having antenna circuitry mounted thereon and the second earth circuit board combined together satisfy a predetermined earth pattern length by having the second earth circuit board moved outward from a body of the transmission/reception apparatus.

A transmission/reception apparatus according to another embodiment of the present invention is the transmission/reception apparatuses described above, wherein the second earth circuit board has a clip means for clipping the transmission/reception apparatus onto, for example, a pocket.

According to the present invention, even if a transmission/reception apparatus is downsized, and a housing space for an antenna becomes smaller, the antenna can be housed in a body of the transmission/reception apparatus, while still being able to secure an earth pattern length required to use the transmission/reception apparatus, and there is no danger of lowering the transmission/reception sensitivity.

According to the present invention, a transmission/reception apparatus which can house an antenna and whose transmission/reception sensitivity is not lowered even if the transmission/reception apparatus is downsized, and a housing space for the antenna thereby becomes smaller can be provided.

According to the present invention, a folding transmission/reception apparatus can secure an earth pattern length required for transmission/reception even in its portable state (folded), and thus the transmission/reception sensitivity does not become lower even while it is being carried in a pocket on clothing, for example.

According to the present invention, because a clip means is provided for attaching the transmission/reception apparatus to pockets on clothing, for example, the danger of dropping or losing the transmission/reception apparatus while carrying it or while it is standing by for an in-coming call is reduced.

BRIEF DESCRIPTION OF THE DRAWINGS

The above and other aspects, features and advantages of the present invention will become more apparent to those skilled in the art from the following description of the presently preferred exemplary embodiments of the invention taken in conjunction with the accompanying drawings, in which.

DESCRIPTION OF THE PREFERRED EMBODIMENTS

Figure 1:
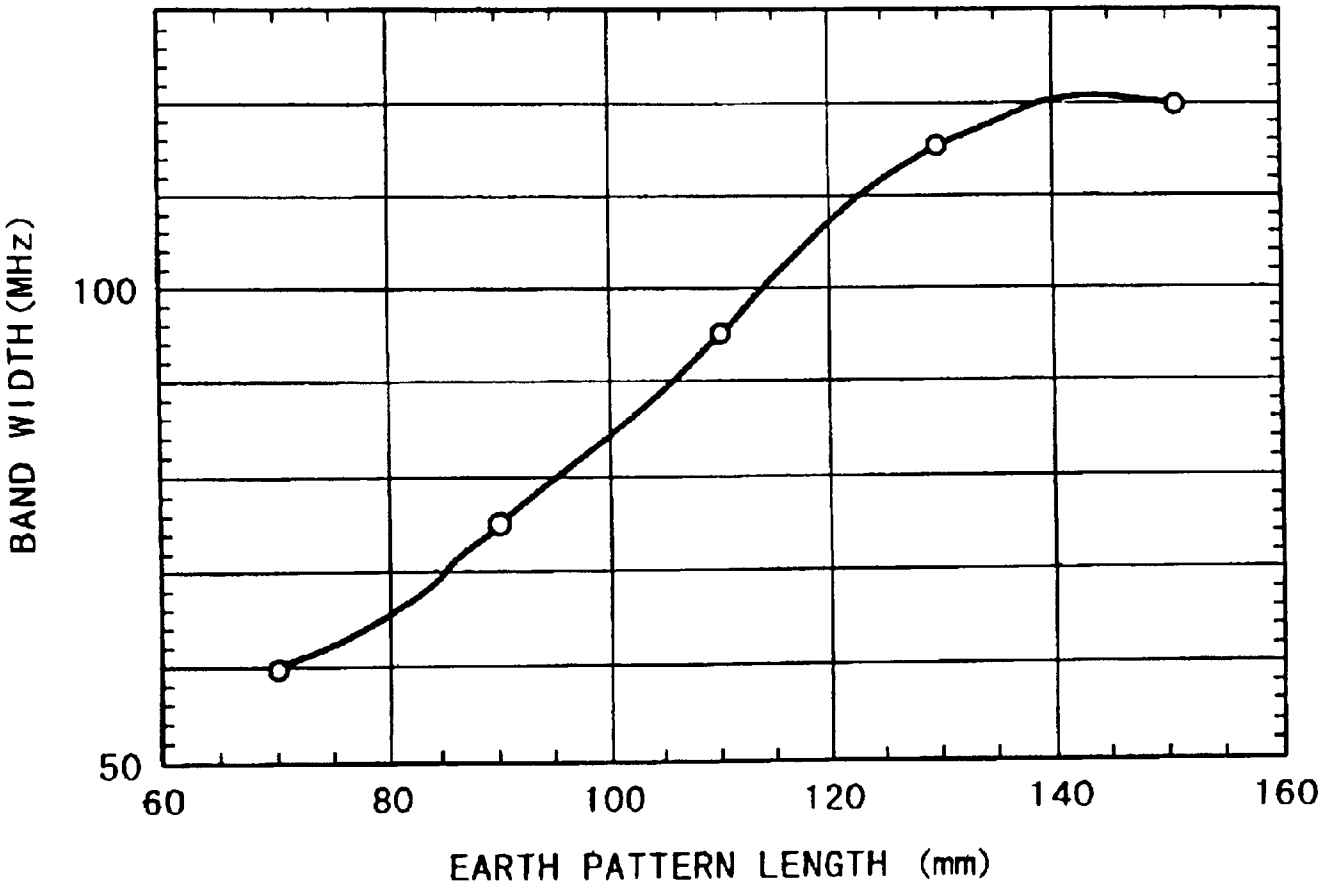
FIG. 1 is a band width vs earth pattern length characteristic graph concerning a patch antenna.

First, the band width characteristics of a patch antenna is reviewed below. Because a patch antenna is used for both transmission as well as reception, it must cover the frequency bands of carrier waves for both transmission and reception. The band width currently in use world-wide is the 900 MHz band (880–915 MHz and 925–960 MHz), which is standardized by GSM (Global System for Mobile Communications—a pan-European mobile phone system). The required band width in the 900 MHz band is at least 80 MHz of which 35 MHz is allocated for transmission, another 35 MHz for reception and an additional 10 MHz is allocated in between as a duplex spacing.

Figure 7A:
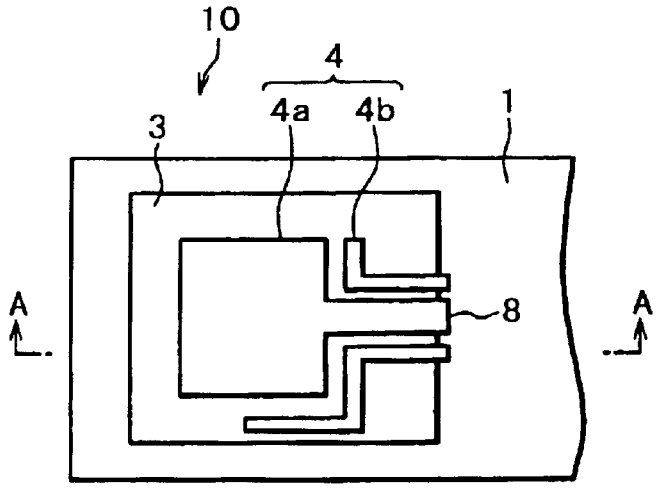
FIG. 7A (PRIOR ART)
FIG. 7A through FIG. 7C are configuration diagrams of a conventional patch antenna, and are a plan view, a cross-sectional view through section A—A of FIG. 7A and a side view of FIG. 7A, respectively.
Figure 7B:
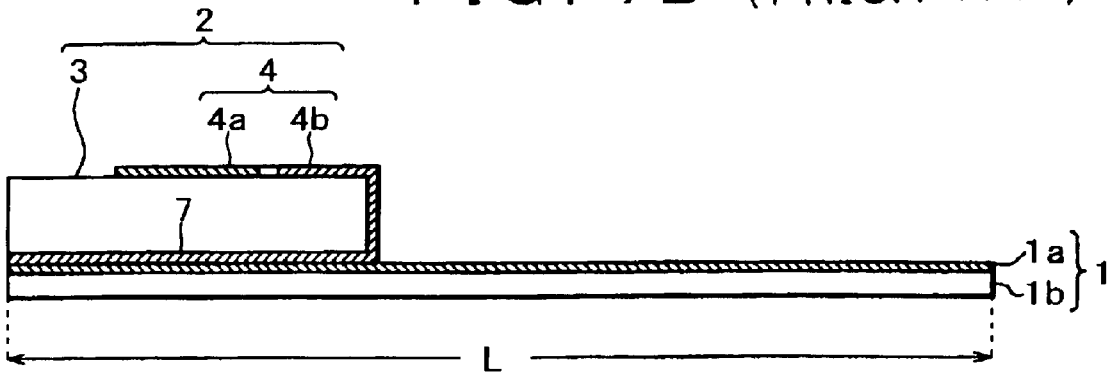
FIG. 7B (PRIOR ART)
Figure 7C:
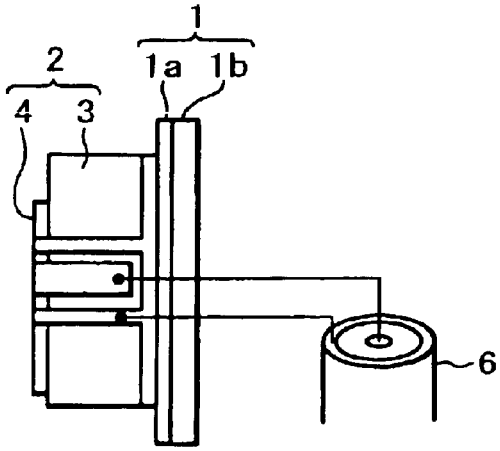
FIG. 7C (PRIOR ART)
Figure 8A:
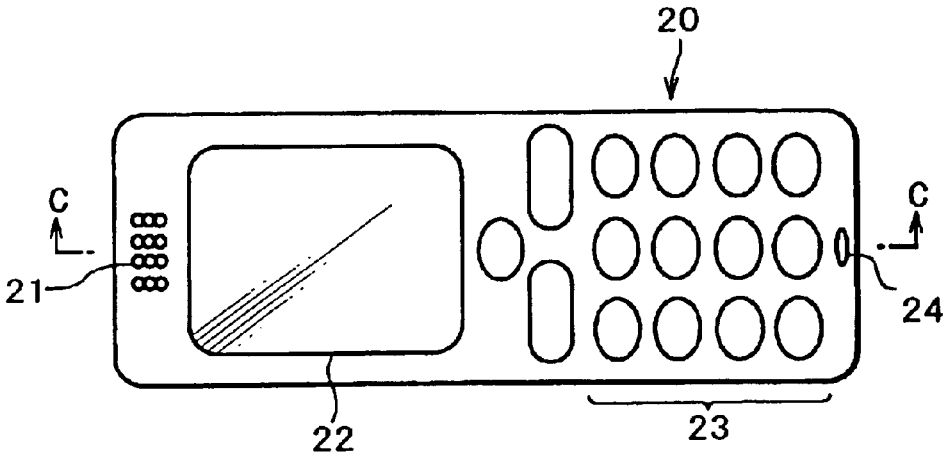
FIG. 8A (PRIOR ART)
FIG. 8A and FIG. 8B are a front view and a cross-sectional view, respectively, of a conventional transmission/reception apparatus.
Figure 8B:
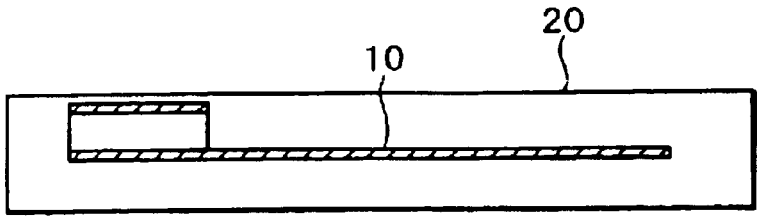
FIG. 8B (PRIOR ART)

FIG. 1 shows band width (MHz) characteristics relative to earth pattern length with respect to a patch antenna shown in FIG. 7A–FIG. 7C. As is indicated in FIG. 1, in order to secure a band width of 80 MHz, an earth pattern length of at least 90 mm is necessary.

Figure 2A:
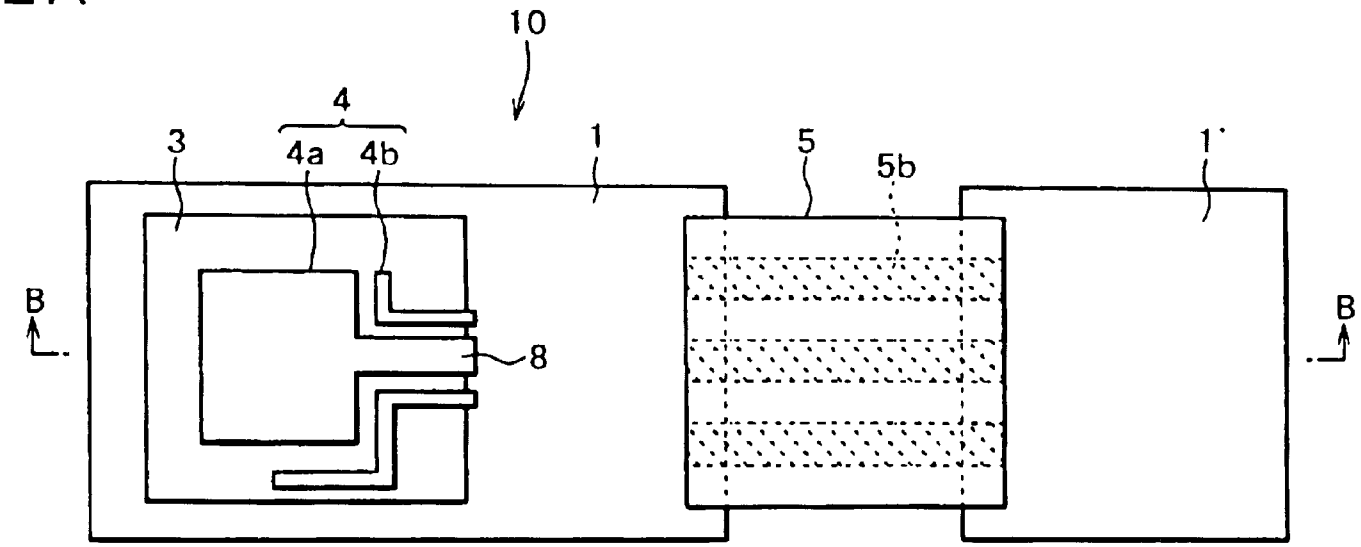
FIG. 2A and FIG. 2B show the configuration of a patch antenna according to an embodiment of the present invention, and are a plan view and a cross-sectional view through section B—B, respectively.
Figure 2B:
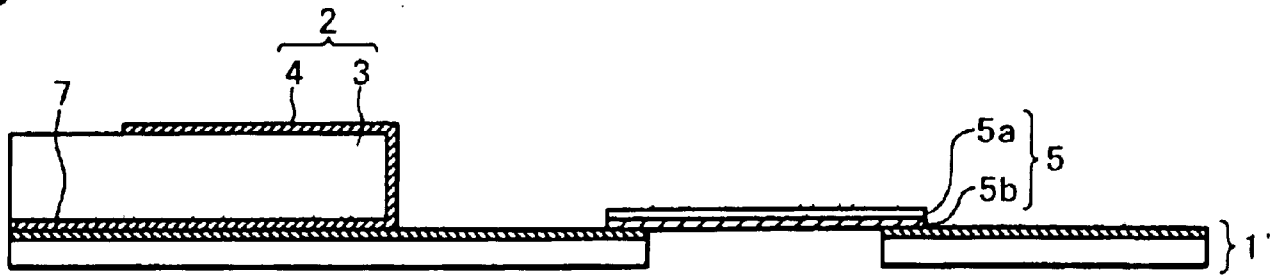

FIG. 2A is a plan view of a patch antenna according to an embodiment of the present invention, and FIG. 2B is a cross-sectional view through section B—B of FIG. 2A. A patch antenna 10 has a basic structure that is similar to the structure described above with reference to FIGS. 7A through 7C. In FIG. 2A and FIG. 2B, elements found in FIGS. 7A through 7C are identified with the same reference numerals.

In the present embodiment, besides an earth circuit board 1 for a patch antenna 10, a second earth circuit board 1' is provided for the patch antenna 10. The earth circuit board 1 and the second earth circuit board 1' are electrically and mechanically connected by way of a flexible conduction means 5, which has a plurality of conductive wires 5*b* configured by etching, or other means, on a flexible thin resin plate 5*a*. In other words, even if a housing space for the patch antenna 10 becomes small, and securing an earth pattern length of 90 mm or above required to secure a band width of 80 MHz by the length of the earth circuit board 1 alone becomes impossible, by connecting the earth circuit board 1 to the second earth circuit board 1' with the flexible conduction means 5, the required earth pattern length mentioned above is secured.

In an embodiment of the present invention, even if the housing space for the patch antenna 10 becomes smaller, the second earth circuit board 1' can be housed in a separate location by having the flexible conduction means 5 folded. Further, during use, the second earth circuit board 1' is positioned to secure an earth pattern length of 90 mm or above together with the earth circuit board 1, and therefore the transmission/reception sensitivity in the 900 MHz band can be prevented from being impaired.

Figure 3A:
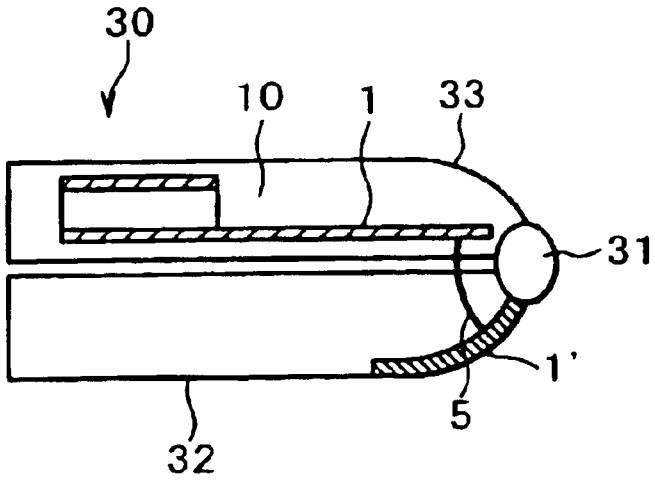
FIG. 3A and FIG. 3B are cross-sectional views of a transmission/reception apparatus according to an embodiment of the present invention.
Figure 3B:
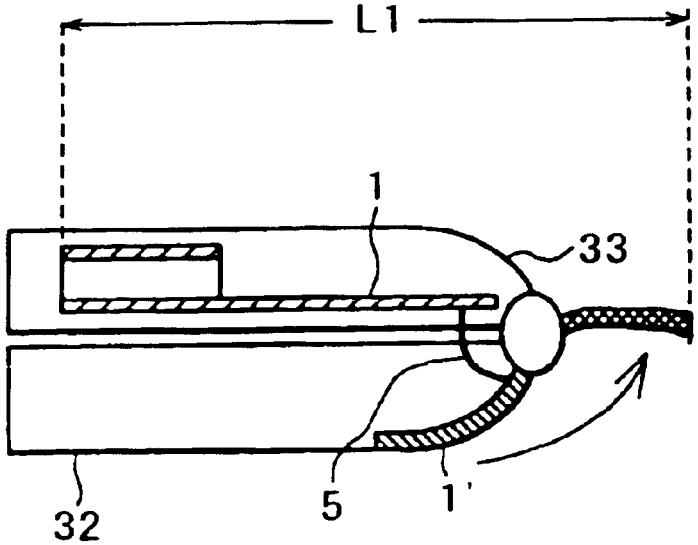
Figure 9A:
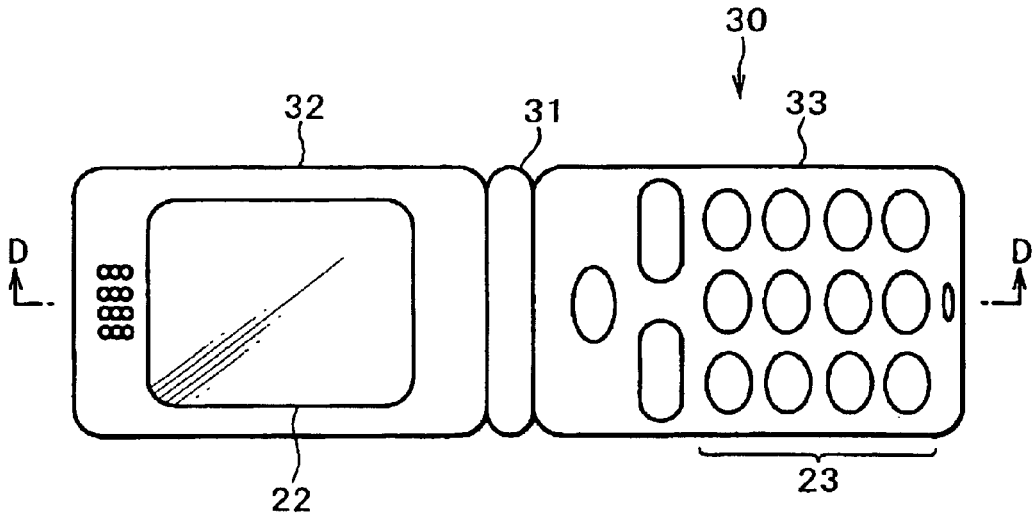
FIG. 9A (PRIOR ART)
FIG. 9A and FIG. 9B are a front view and a cross-sectional view, respectively, of a conventional transmission/reception apparatus.
Figure 9B:
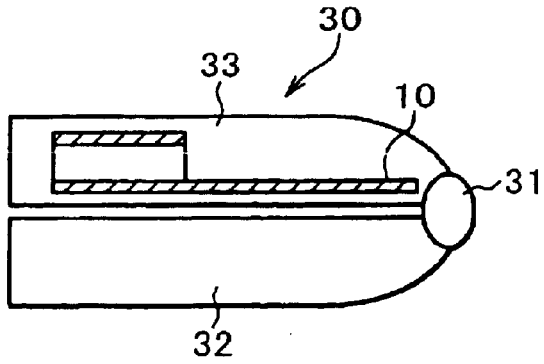
FIG. 9B (PRIOR ART)

FIG. 3A and FIG. 3B are cross-sectional configuration diagrams of a folding transmission/reception apparatus according to an embodiment of the present invention. This transmission/reception apparatus, except for the configuration of its antenna, is identical with the transmission/reception apparatus described above with reference to FIG. 9A and FIG. 9B.

In FIG. 3A, a patch antenna 10 comprising an earth circuit board 1 of an earth pattern length housable in a dial button side 33 of a transmission/reception apparatus 30 is provided on the dial button side 33. On another side of the transmission/reception apparatus 30, in other words a display side 32, a second earth circuit board 1' comprising a rotation axle not shown with a folding section 31 in the diagram is provided such that the second earth circuit board 1' is housed along the outer surface of a body of the display side 32. The earth circuit board 1 and the second earth circuit board 1' are connected by a flexible conduction means 5, and a total earth pattern length L1 is maximized by rotating the second earth circuit board 1' around the rotation axle and away from the body of the display side 32 in the direction indicated by the arrow shown in FIG. 3B.

In FIG. 3A and FIG. 3B, a connection between the earth circuit board 1 and the second earth circuit board 1' by the flexible conduction means 5 is drawn schematically, but in practice, options such as passing the connection through the folding section 31 are adopted.

Through the present embodiment, even if a transmission/reception apparatus is structured so as to be foldable, and an antenna housing space becomes smaller, an antenna whose earth pattern length is easily extendable can be configured. Thus, a transmission/reception apparatus whose sensitivity can be guaranteed for transmission and reception in the 900 MHz band can be provided.

Figure 4A:
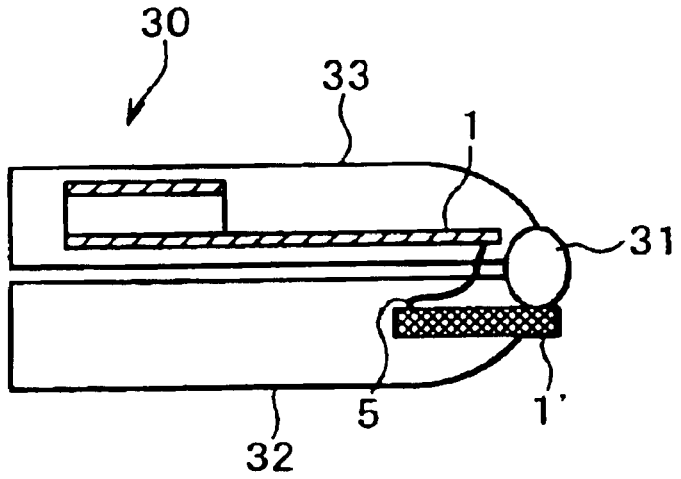
FIG. 4A and FIG. 4B are cross-sectional views of a transmission/reception apparatus according to an embodiment of the present invention.
Figure 4B:
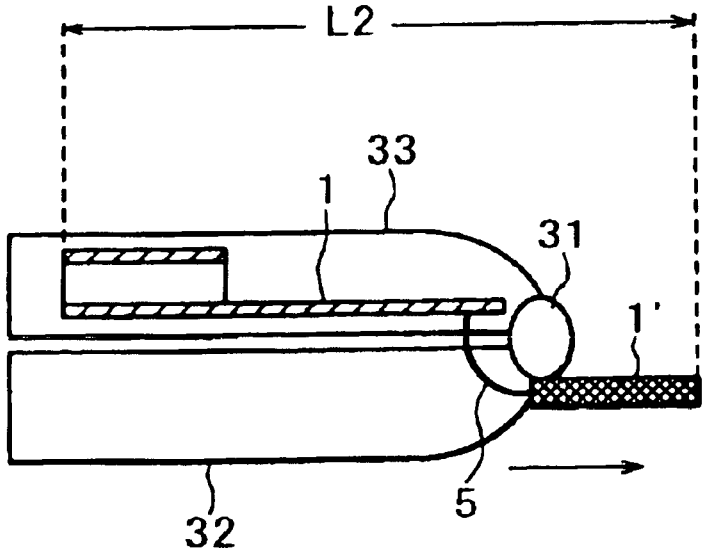

FIG. 4A and FIG. 4B are cross-sectional views of a folding transmission/reception apparatus showing the configuration of a patch antenna according to another embodiment of the present invention. Again, the transmission/reception apparatus shown in these diagrams, except for the configuration of its antenna, is identical with the transmission/reception apparatus described above with reference to FIG. 9A and FIG. 9B.

As shown in FIG. 4A, a second earth circuit board 1' is configured so that it can be pulled out from a display side 32 of a folding transmission/reception apparatus 30 in the direction indicated by the arrow shown in FIG. 4B, and the second earth circuit board 1' is connected to an earth circuit board 1 by a flexible conduction means 5. Further, a total earth pattern length L2 of the earth circuit board 1 and the second earth circuit board 1' combined is maximized when the second earth circuit board 1' is pulled out of a body of the folding transmission/reception apparatus 30.

Through the present embodiment, because the total earth pattern length can easily be extended by pulling the second earth circuit board 1' out from the body of the folding transmission/reception apparatus 30, even if the folding transmission/reception apparatus 30 is downsized, a transmission/reception apparatus whose sensitivity for transmission/reception in the 900 MHz band can be guaranteed is provided.

In yet another embodiment of the present invention, the folding transmission/reception apparatus 30 described above having the second earth circuit board 1' which can be inserted in and pulled out from the body of the folding transmission/reception apparatus 30 is made capable of being clipped onto some objects, such as pockets on clothing, while in use or in stand-by mode, by having a clip member provided on the second earth circuit board 1' of the patch antenna 10.

Figure 5A:
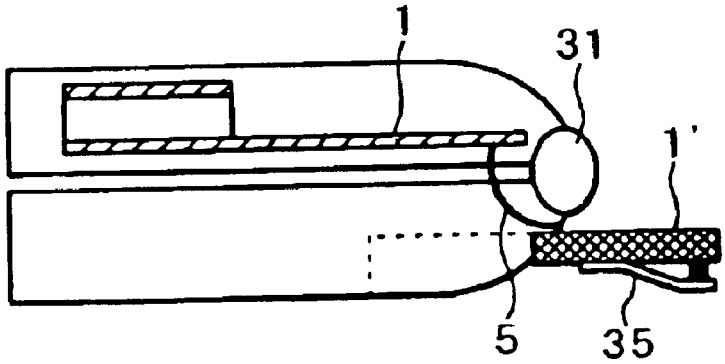
FIG. 5A and FIG. 5B are a cross-sectional view and a front view, respectively, of a transmission/reception apparatus according to an embodiment of the present invention.
Figure 5B:
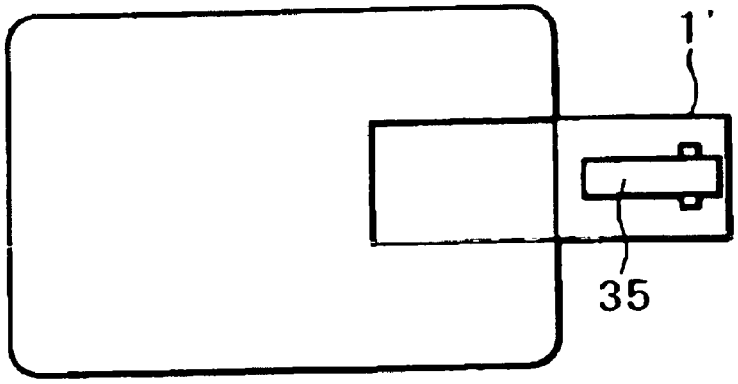

FIGS. 5A and 5B are a cross-sectional view and a front view, respectively, of a folding transmission/reception apparatus having an earth circuit board with a clip, and shows such an apparatus as folded and with the earth circuit board pulled out. In the present embodiment, a clip 35 is attached to a second earth circuit board 1' by an appropriate spring member not shown in the diagram so that the clip 35 exerts a pinching force. By clipping this transmission/reception apparatus onto, for example, a pocket on a shirt using the clip 35, dropping or losing the transmission/reception apparatus can be prevented.

Figure 6A:
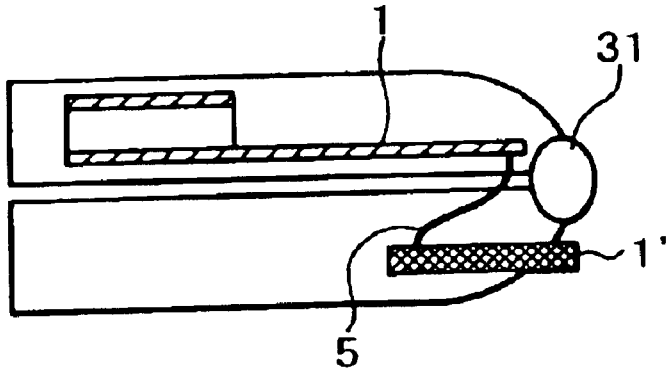
FIG. 6A and FIG. 6B are a cross-sectional view and a front view, respectively, of a transmission/reception apparatus according to an embodiment of the present invention.
Figure 6B:
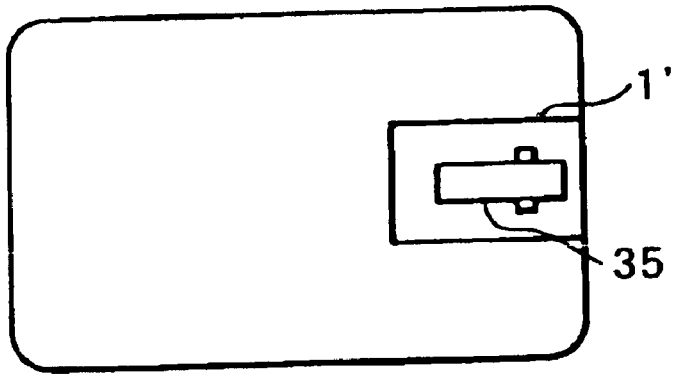

FIG. 6A and FIG. 6B are a cross-sectional view and a front view, respectively, of a folding transmission/reception apparatus with a second earth circuit board 1', which has a clip 35, inserted inside the folding transmission/reception apparatus.

The second earth circuit board 1' having the clip 35 is capable of clipping itself onto, for example, a pocket on clothing while the second earth circuit board 1' is inserted inside the folding transmission/reception apparatus.

Through the present embodiment, because the transmission/reception apparatus can be clipped onto, for example, a pocket by the clip 35, there is less danger of dropping or losing the transmission/reception apparatus while in stand-by mode or while carrying it around.

It should be understood that the antenna apparatus and the transmission/reception apparatus of the present invention is not limited to the description of the preferred embodiments herein, inasmuch as the present invention is capable of other embodiments and of being practiced or carried out in various ways, and that it is intended to cover all changes and modifications of the examples of the invention herein chosen for purposes of the disclosure. Accordingly, any variations, combinations and sub-combinations of the present preferred embodiments should be permitted without departing from the technical scope of the invention.

What is claimed is:

1. An antenna apparatus, comprising:

a first earth circuit board having an antenna circuit arranged thereon;

a second earth circuit board; and a flexible conduction means having a plurality of conductive wires etched on a flexible, thin resin plate for electrically connecting said first earth circuit board and said second earth circuit board.

2. A transmission/reception apparatus, comprising:

a first housing;

a second housing;

a folding section mechanically connecting said first housing and said second housing;

a first earth circuit board having an antenna circuitry arranged thereon and provided with said first housing;

a second earth circuit board provided with said second housing; and flexible conduction means for electrically connecting said first earth circuit board and said second earth circuit board, wherein said first earth circuit board, said second earth circuit board, and said flexible conduction means constitute an antenna apparatus, wherein said second earth circuit board is movable outwardly from said second housing of said transmission/reception apparatus and during use of said antenna apparatus a predetermined earth pattern length is formed by said first earth circuit board having said antenna circuitry arranged thereon and said second earth circuit board.

3. A transmission/reception apparatus comprising:

a first housing;

a second housing;

a folding section mechanically connecting said first housing and said second housing;

a first earth circuit board having an antenna circuitry arranged thereon and provided with said first housing;

a second earth circuit board provided with said second housing;

flexible conduction means for electrically connecting said first earth circuit board and said second earth circuit board, wherein said first earth circuit board, said second earth circuit board, and said flexible conduction means constitute an antenna apparatus, and clip means provided on said second earth circuit board.

4. The transmission/reception apparatus according to claim 3, further comprising:

clip means provided on said second earth circuit board.

* * * * *